US006857581B2

(12) United States Patent
Steiger

(10) Patent No.: US 6,857,581 B2
(45) Date of Patent: Feb. 22, 2005

(54) SPRAYING METHOD AND A SPRAY SYSTEM FOR COATING LIQUIDS

(75) Inventor: Ronald Steiger, Gross-Zimmern (DE)

(73) Assignee: ITW Oberflachentechnik GmbH & CO. KG, Dietzenbach (DE)

( * ) Notice: Subject to any disclaimer, the term of this patent is extended or adjusted under 35 U.S.C. 154(b) by 204 days.

(21) Appl. No.: 10/042,394

(22) Filed: Jan. 11, 2002

(65) Prior Publication Data

US 2002/0092922 A1 Jul. 18, 2002

(30) Foreign Application Priority Data

Jan. 13, 2001 (DE) ..... 101 01 372

(51) Int. Cl.[7] ..... B05B 1/24; B05B 15/00

(52) U.S. Cl. ..... 239/128; 239/132; 239/132.1; 239/132.3; 239/132.5; 239/424.5

(58) Field of Search ..... 239/128, 132, 239/132.1, 132.5, 132.3, 398, 406, 407, 413, 417.5, 418, 419, 424, 424.5, DIG. 14, 240, 538

(56) References Cited

U.S. PATENT DOCUMENTS

| | | | | | |
|---|---|---|---|---|---|
| 3,033,472 | A | * | 5/1962 | Shelton, V | 239/408 |
| 3,606,154 | A | * | 9/1971 | Tufts | 239/8 |
| 3,731,145 | A | | 5/1973 | Senay | |
| 3,858,072 | A | | 12/1974 | Dembovsky | |
| 3,927,833 | A | * | 12/1975 | Harrison et al. | 239/306 |
| 4,236,059 | A | | 11/1980 | McComas et al. | |
| 4,275,383 | A | | 6/1981 | White et al. | |
| 4,505,430 | A | | 3/1985 | Rodgers et al. | |
| 4,597,919 | A | | 7/1986 | Ramser et al. | |
| 4,844,348 | A | | 7/1989 | Rutz | |
| 4,928,883 | A | | 5/1990 | Weinstein | |
| 5,065,692 | A | | 11/1991 | Hollesen et al. | |
| 5,106,025 | A | | 4/1992 | Giroux et al. | |
| 5,120,582 | A | | 6/1992 | Browning | |
| 5,209,948 | A | | 5/1993 | Talacko | |
| 5,219,690 | A | * | 6/1993 | Hammond | 430/58.05 |
| 5,233,153 | A | | 8/1993 | Coats | |
| 5,303,865 | A | * | 4/1994 | Bert | 239/9 |
| 5,639,027 | A | * | 6/1997 | Fritz | 239/414 |
| 5,707,009 | A | | 1/1998 | Schneider | |
| 5,803,372 | A | * | 9/1998 | Weinstein et al. | 239/703 |
| 5,845,846 | A | * | 12/1998 | Watanabe et al. | 239/8 |
| 5,914,153 | A | | 6/1999 | Swink et al. | |
| 5,948,476 | A | * | 9/1999 | Otake et al. | 427/352 |
| 6,050,499 | A | | 4/2000 | Takayama et al. | |
| 6,081,281 | A | | 6/2000 | Cleary et al. | |
| 6,273,344 | B1 | * | 8/2001 | Liu | 239/418 |

FOREIGN PATENT DOCUMENTS

| | | |
|---|---|---|
| DE | 220888 | 4/1910 |
| DE | 825379 | 7/1949 |
| DE | 847578 | 8/1952 |
| DE | 913520 | 7/1954 |
| DE | 30 00 002 | 1/1980 |
| DE | 3225844 | 7/1982 |
| DE | 31 05 186 A1 | 9/1982 |
| DE | 31 35 721 A1 | 3/1983 |
| DE | 3504167 | 2/1985 |
| DE | 35 09 874 | 3/1985 |
| DE | 4017603 | 7/1991 |
| DE | 4443811 | 6/1996 |
| DE | 86 07 841 A2 | 3/1998 |
| DE | 19816648 | 11/1998 |
| EP | 0237668 | 9/1987 |
| EP | 0283917 | 9/1988 |
| EP | 0480226 | 4/1992 |
| EP | 0 827 781 | 3/1998 |
| EP | 0878238 | 9/1998 |
| EP | 1048359 | 11/2000 |
| FR | 2626199 | 7/1989 |
| GB | 2 076 697 | 12/1981 |
| JP | 59093804 | 5/1984 |

* cited by examiner

*Primary Examiner*—Davis Hwu
(74) *Attorney, Agent, or Firm*—Lowe Hauptman & Berner, LLP

(57) ABSTRACT

A spraying method and a spray system which comprises a unit (16) metering accessory liquid into the coating-liquid's spray jet (14).

16 Claims, 2 Drawing Sheets

SPRAYING METHOD AND A SPRAY SYSTEM FOR COATING LIQUIDS

FIELD OF THE INVENTION

BACKGROUND OF THE INVENTION

The present invention relates to a spray method and a spray system.

Spray equipment comprising a rotary atomizer in the form of a so-called bell to atomize and spray coating liquids onto an object to be coated are known from the U.S. Pats. No. 4,275,838 and 4,505,430; German patent documents 30 00 002 A1 and 35 09 874 A1. They disclose applying a high electrical potential, which may be positive or negative, to the rotary atomizers and/or to the spray coating liquid. Typically the high voltage is in the range of 4 kV to 140 kV. A high-voltage spray system fitted with an irrotational spray nozzle is known form U.S. Pat. No. 3,731,145.

Rotary atomizing elements conventionally assume a bell shape or a disk form and may rotate at speeds up to 60,000 rpm.

The coating liquid may contain solvents or it may be a water-dilutable liquid, in particular paint, colored or clear lacquers/enamels.

The various kinds of coating liquids exhibit different viscosities and different drying rates. The liquid particles in the spray jet assume different shapes, sizes and flight properties on their way from the liquid atomizer to the object to be coated.

The high voltage generates an electric field between the spray system and an electrically conducting, grounded object to be coated. In this manner spray-jet scattering losses are reduced and higher coating rates and better coating qualities are attained. The adhesion of the liquid particles to the object to be coated depend on the kind of coating liquid and the electrostatic field.

SUMMARY OF THE INVENTION

The objective of the invention is to control in simple and economical manner the efficiency of coating and the quality of coating.

Accordingly the present invention concerns a coating-liquid spraying method wherein coating liquid is sprayed from a spray system through a liquid atomizer in the form of an irrotational nozzle or in the form of a rotating rotary atomizing element onto an object to be coated, said method being characterized in that an accessory liquid is fed in metered manner into the coating liquid's spray jet and thereby it controls the micro-climate in the spray jet.

Moreover the invention relates to a coating-liquid spray system containing a liquid atomizer in the form of an irrotational nozzle or in the form of a rotating rotary atomizing element to spray coating liquid onto an object to be coated, said spray system being characterized in that it includes a feed device of accessory liquid to feed coating material in metered manner into the coating liquid's spray jet.

On account of this metered feed of accessory liquid onto or into the coating liquid's spray jet, the "microclimate" in said spray jet and hence also the coating efficiency and the quality of coating may be controlled and matched to various practical requirements.

The "microclimate" in particular relates to the spray jet's moisture content and the ratio of the volatile ingredients to non-volatile ingredients in the spray jet. Illustratively the paint/pigment particles of coating liquids of low viscosities may be"thinned" by applying the accessory liquid and consequently they may then be better atomized in the spray jet and be also better charged electrostatically. Depending on the kind of accessory liquid, latter also affects the electrical current between the spray system's spray jet and the grounded object to be coated. The accessory liquid furthermore affects the fluidity of the coating liquid's liquid particles on the object to be coated.

In a particular embodiment of the invention, the coating liquid is cooled prior to its atomization in the spray system, for instance in the liquid atomizing element or upstream of it. As a result the viscosity and the rate of evaporation (drying) of the coating liquid shall be reduced. Therefore the microclimate also can be controlled and the efficiency and quality of coating also can be improved.

Water is appropriately used for water-dilutable coating liquids or solvents for coating liquids containing solvents.

Preferably the accessory liquid shall be fed into the starting zone of the spray jet before said jet has grown to its full diameter, namely by pointing the accessory-liquid feed into the spray jet's starting zone.

Especially good results shall be attained by feeding the accessory liquid by means of the accessory-liquid feeding device which is pointed at the spray jet to the front end or downstream of it in the vicinity of the liquid atomizer's front end to the spray jet.

Depending on the accessory liquid being fed onto or into the spray jet at only one spot on periphery or over a larger peripheral arc or over the entire periphery of the spray jet, the properties of this spray jet may be matched to different kinds of objects and to different kinds of coating liquids. This feature also allows taking into account whether the object surface to be coated is vertical or horizontal. Illustratively, there is danger as regards vertical or oblique object surfaces that the deposited coating liquid shall drain downward. A slitted nozzle completely or partly enclosing the spray-jet axis, or one or a plurality of round or polygonal apertures, in particular nozzle apertures configured about the spray-jet axis, may be configured at the spray system to implement discharge of the accessory liquid.

Just as in the state of the art, the spray system may be fitted with one or more of the following sources of compressed-air: shaping air, configured on the sprayjet and illustratively enclosing it like a bell and jointly flowing with it to shape it; bearing air supporting the rotary atomizing element and/or a turbine driving it; turbine air to drive the turbine; deceleration air to slow the turbine and the rotary atomizing element. One or more kinds of this air may be cooled in the manner of the invention and may be used as a coolant to cool the coating liquid in the spray system.

BRIEF DESCRIPTION OF THE DRAWINGS

The invention is elucidated below in relation to the drawings and in relation to a preferred illustrative embodiment.

DETAILED DESCRIPTION OF THE INVENTION

Figure 1:
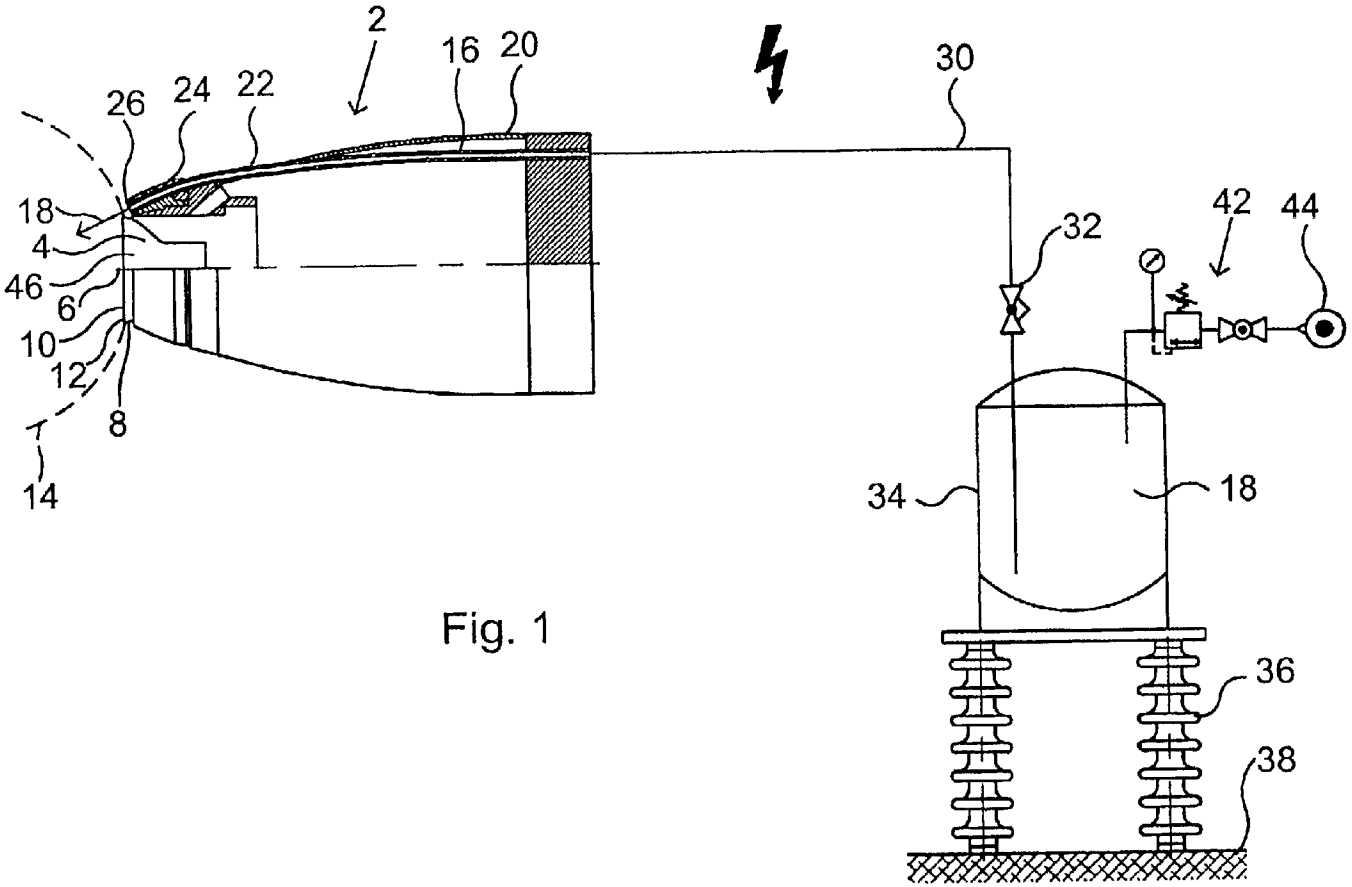
FIG. 1 schematically shows a sideview at the bottom and at the top a longitudinal section of a spray system of the invention, FIG. 2 schematically shows a front view from the left of the spray system of FIG. 1, and FIG. 3 schematically shows a sideview at the bottom and at the top a longitudinal section of a further embodiment of the spray system of the invention.
Figure 2:
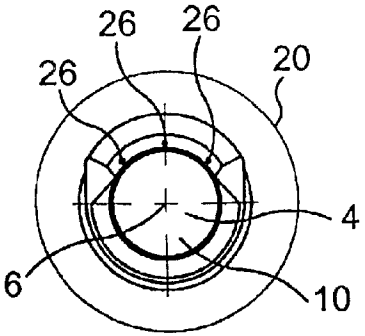

The coating-liquid spray system 2 of the invention shown in the drawings comprises a liquid atomizer in the form of a rotary atomizing element 4 driven by an omitted air turbine. Said element preferably shall be an atomizing bell or pane rotating about an axis 6, further an external peripheral surface 8 and a front end surface 10 .The end surface 10 assumes the shape of a bell (or saucer). Coating liquid issuing from the bell's edge 12—that is from the external periphery of the end surface 10 on account of the centrifugal force produced by the rotary atomizing element 4 in the form of a forward pointing spray jet 14—flows radially from inside to outside on the rotating end surface 10.

The rotary atomizing element 4 preferably shall be connected to a high voltage to generate a high electric field between it and the object to be coated.

A supply unit 16 to feed metered accessory liquid 18 onto and/or into the sprayjet 14 contains an accessory-liquid line 22 running on or through a spray-system housing 20 to a discharge element 24 mounted on or in said housing 20. The discharge element 24 is fitted with at least three discharge apertures 26 through which the accessory liquid 18 streams forward into the spray jet 14.

At the rear end of the housing 20, the accessory-liquid line 22 is connected by means of an external accessory-liquid feed line 30 containing a controlled valve 32 to a supply container 34 storing the accessory liquid 18. The voltage applied to the rotary atomizing element 4 also may be applied to the accessory liquid 18 which therefore rests by means of electrical insulators 36 on a subfloor 38.

A pump may be used to convey the accessory liquid to the discharge element 24. FIG. 1 shows another embodiment wherein a gas-pressure regulator 42 generates a gas pressure in the supply container 34, preferably the compressed air from a compressed-air source 34, by means of which accessory liquid 18 will be forced, when said valve 32 is open, out of the supply container 34 toward the discharge element 24 and from there into the spray jet 14.

Preferably the accessory liquid 18 provided in the spray jet 14 shall be water soluble. The accessory liquid 18 preferably shall be a solvent when the coating liquid of the spray jet 14 contains solvents. The feed of the accessory liquid 18 into the spray jet 14 allows modifying and matching the viscosity of the spray mist or of the microclimate of the spray jet 14 with respect to different coating liquids.

The device feeding coating liquids to the rotary atomizing element 4 is omitted because known from the state of the art, for instance from U.S. Pat. Nos. 4,275,838 and 4,505,430.

The minimum of one discharge aperture 26 for accessory liquid 18 may be cross-sectionally circular or polygonal or a slit, illustratively it may be a slotted nozzle running over part or all the system periphery about the axis of rotation 6.

The accessory liquid 18 is metered toward the spray jet 14. The microclimate (moisture content, temperature, viscosity) in the liquid jet 14 can be controlled as a function of operational conditions, for instance the kind of coating liquid and the kind of object to be coated, while simultaneously the coating efficiency and quality are improved.

The accessory liquid 18 is fed to the starting zone of the liquid jet 14 before said jet attains its largest diameter. Preferably the accessory liquid 18 is fed directly at the front end of the liquid atomizer 4 to the spray jet 14.

The discharge aperture(s) 26 may be in the form of nozzle aperture(s) from which the accessory liquid 18 exits as a thick or as an atomizer jet.

The accessory liquid 18 either can be directly pointed from the minimum of one discharge aperture 26 into the spray jet 14, or in such a way that at least a portion of or all the accessory liquid 18 moves from the discharge apertures 26 onto the peripherally external terminal segment 46 of the rotary atomizing element 4 and is guided by said segment 46 into the spray jet 14. The feed element 16 for the accessory liquid 18, in particular the discharge apertures 26 and the feed pressure of the accessory liquid 18, either may be selected in such a way that the accessory liquid 18 issues from the discharge apertures 26 in the form of a liquid jet, or that the accessory liquid issues only drip-wise from the discharge apertures 26 and drips on the peripherally external terminal segment 46 of the rotary atomizing element 4. The rotation of the rotary atomizing element 4 generates a centrifugal force flinging the accessory liquid 18 from its external periphery's terminal zone 46 into the spray jet 14 of the coating liquid.

Spraying at least a portion of the accessory liquid 18 onto the external periphery's terminal segment 46 of the rotary atomizing element 4 offers a further advantage in that no coating liquid particles will deposit on said zone 46 where they might cure. Accordingly this terminal zone 46 of the external periphery will be kept clean.

Figure 3:
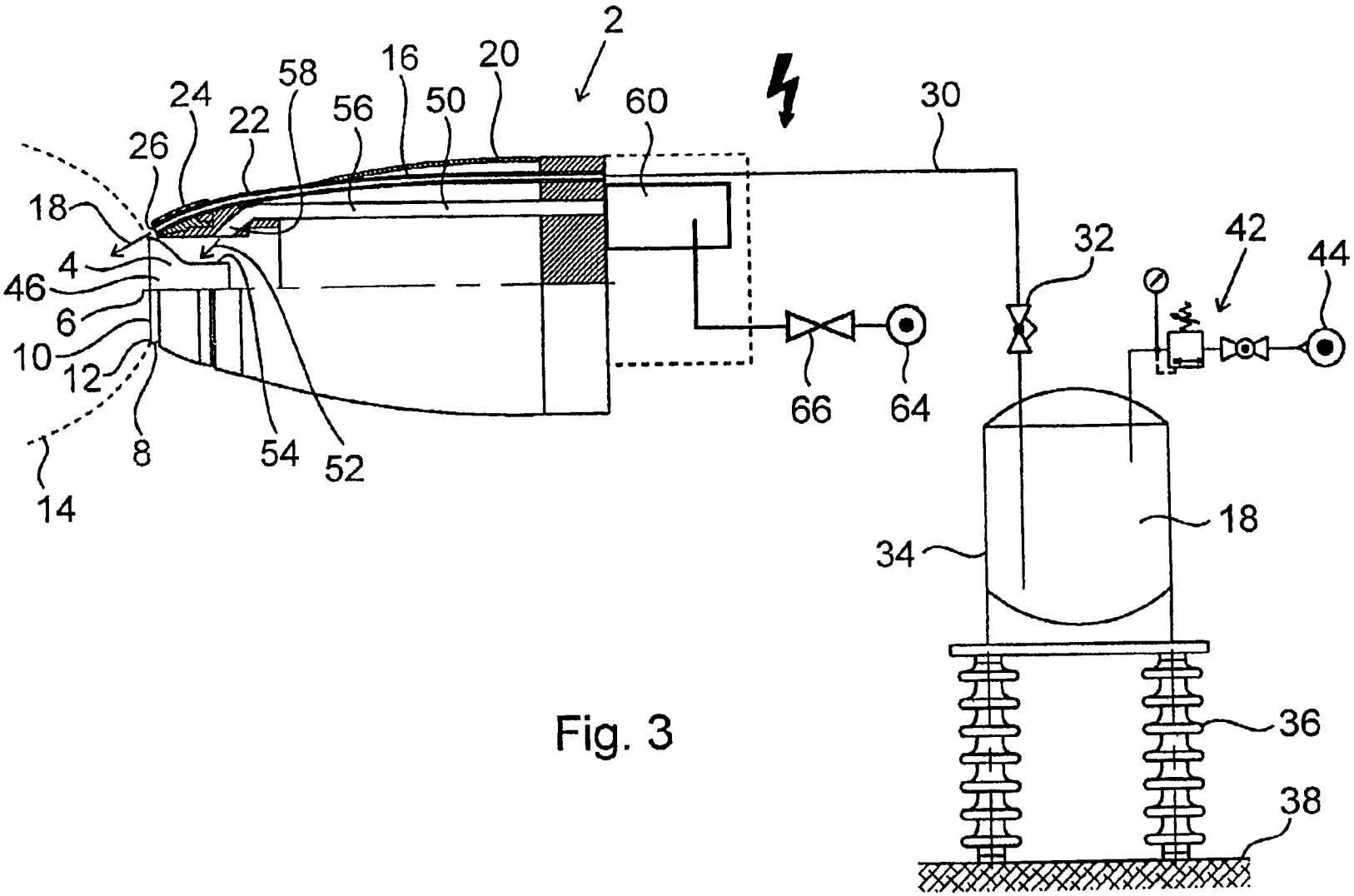

The further embodiment of a spray system of the invention shown in FIG. 3 preferably also includes a cooling unit 50 to cool a system component in contact with the coating liquid on its way to the spray jet 14, said cooling being implemented in the present embodiment of the rotary atomizing element 4 by means of a fluid, cooled medium, during spray coating, in order to transmit the cold of the cooled coolant through the cold-conducting system component, preferably the rotary atomizing element 4, to the spray coating liquid before the latter is sprayed away. In the embodiment of FIG. 3, the coolant 52 is guided behind the terminal zone 46 of the external periphery onto the external periphery surface 54, and the cold from the coolant 52 is transmitted to the coating liquid flowing through it which thereupon is sprayed as the spray jet 14.

The cooling unit 50 has a coolant line 56 to guide the coolant 52, which preferably is a cooled compressed gas, in particular cooled compressed air, inside the coolant line 56 to a coolant discharge 58 that points at the external peripheral surface 54 of the rotary atomizing element 4. The cold of the coolant 52 passes through the rotary atomizing element 4 as far as its end surface 10 over which flows the coating liquid centrifuged by the rotating rotary atomizing element 4 and from which the coating liquid 18 is flung off at the outer edge of said element in the form of the spray jet 14.

A cooler 60 to the coolant 52 preferably shall be directly mounted on the spray system 2 or be integrated into it. In this way short paths are implemented for the coolant 52. The coolant 52 preferably shall be a compressed gas, for instance compressed air from a compressed-air source 64, and it is metered through a metering element 66 (for instance a valve) and it is guided through a part of the coolant line 56 to the cooler 60 and cooled by the latter and thereupon it is guided onto the rotary atomizing element 4. The cooler 60 may contain a so-called cooling gas cartridge to coll the coolant 52.

Cooling the rotary atomizing element by the coolant 52 offers the further advantage that it cools said element as far as into its terminal segment 46 of the external periphery. Sometimes coating-liquid particles migrating rearward out of the spray jet 14 will reach said terminal zone 46 of the external periphery. The lowered temperature assures that said coating-liquid particles will cure at substantially lower rates and adhere substantially less to the terminal zone 46 of the external periphery than at higher temperatures. Consequently less cleaning shall be required.

What is claimed is:

1. A method of spraying coating liquid, said method comprising the steps of:

spraying the coating liquid in form of a spray jet from a liquid atomizer of a spray system onto an object to be coated; and controlling a property of said spray jet by metering an accessory liquid into the spray jet;

wherein said accessory liquid being metered into said spray jet at a location outside said liquid atomizer; and said coating liquid is a solution of a solvent and said accessory liquid is said solvent.

2. The method as claimed in claim 1, wherein said metering comprises depositing the accessory liquid to a starting zone of the spray jet before said spray jet attains its fill diameter.

3. The method as claimed in claim 1, wherein said liquid atomizer has a front end from which said spray jet begins to travel toward the object to be coated; and said metering comprises depositing said accessory liquid into said spray jet at said front end or at a location in a downstream vicinity of said frond end.

4. The method as claimed in claim 1, wherein said metering comprises depositing the accessory liquid into the spray jet at a number of locations outside the liquid atomizer, said locations being distributed circumferentially over at least a portion of said spray jet.

5. The method as claimed claim 1, wherein said metering comprises depositing the accessory liquid from at least one nozzle aperture which is configured at a front end segment of the spray system, in form of an unbroken jet, to the spray jet.

6. The method of claim 1, wherein said metering is performed during said spraying.

7. The method of claim 1, wherein said solvent is water.

8. The method of claim 1, wherein said metering comprises atomizing said accessory liquid.

9. The method of claim 1, wherein said spray system further includes a system component in contact with the coating liquid being delivered to be sprayed in form of said spray jet;

said method further comprising the step of cooling said system component by a fluidity and cooled coolant, thereby cooling the coating liquid by virtue of thermal conductivity of the system component.

10. A method of spraying coating liquid, said method comprising the steps of:

spraying the coating liquid in form of a spray jet from a liquid atomizer of a spray system onto an object to be coated; and controlling the microclimate in said spray jet by metering an accessory liquid into the spray jet;

wherein said spray system further includes a system component in contact with the coating liquid being delivered to be sprayed in form of said spray jet, and said method further comprises the step of cooling said system component by a fluidic and cooled coolant, thereby cooling the coating liquid by virtue of thermal conductivity of the system component.

11. The method of claim 10, wherein said controlling comprises adjusting at least one of temperature, moisture content, viscosity of said spray jet by said accessory liquid.

12. A coating-liquid spray system, comprising:

a liquid atomizer for spraying a coating liquid in form of a spray let onto an object to be coated, said liquid and atomizer having a front end adapted to face the object to be coated, the front end having an external surface, an internal surface that defines an inner passage for delivering the coating liquid, and an atomizing edge at the boundary of the internal and external surfaces from which atomizing edge the spray jet beams to travel toward the object in operation; and an accessory-liquid feed unit fitted with at least one discharge outlet for metering an accessory liquid into the spray jet;

wherein said at least one discharge outlet is located outside said inner passage;

said at least one discharge outlet points towards a location on the external surface of said font end of said liquid atomizer, said location being rearwardly spaced from said atomizing edge, thereby allowing the accessory liquid to be deposited on the external surface and to be guide by the external surface forwardly into the spray jet;

at least one said discharge outlet of the accessory liquid is located radially, outwardly with respect to the external surface of the front end;

the liquid atomizer is a rotary atomizing element; and the accessory-liquid feed unit is configured to drip the accessory liquid onto the external surface of the front end of the rotary atomizing element.

13. A coating-liquid spray system, comprising:

a liquid atomizer for spraying a coating liquid in form of a spray jet onto an object to be coated;

an accessory-liquid feed unit fitted with at least one discharge outlet for metering an accessory liquid into the spray jet; and a cooling unit for cooling at least one component of the spray-system by moans of a fluid, cooled coolant, said system component being adapted to be an contact with the coating liquid being delivered to be sprayed in form of said spray jet and having a thermal conductivity in order to cool the coating liquid with the coolant.

14. The system as claimed in claim 13, wherein the system component comprises a first portion which is adapted to be in contact with the coating liquid being delivered to be sprayed in form of said the spray jet; and a second portion which is not adapted to be in contact with the spray-coating liquid being delivered to be sprayed in form of said the spray jet;

wherein the cooling unit is configured to discharge the coolant on the second portion of the system component.

15. The system as claimed in claim 14, wherein the liquid atomizer is a rotary atomizing element and the first portion adapted to be in contact with the coating liquid is an external, peripheral surface of the rotary atomizing element.

16. The system as claimed in claim 13, wherein the coolant is a cooled gas.

* * * * *